United States Patent [19]

Rosenfeld

[11] Patent Number: 4,846,244

[45] Date of Patent: Jul. 11, 1989

[54] WINDOW SHUTTER

[75] Inventor: Chaim Rosenfeld, Givatayim, Israel

[73] Assignee: Parma Development Ltd., Gan Shomron, Israel

[21] Appl. No.: 208,530

[22] Filed: Jun. 20, 1988

[30] Foreign Application Priority Data

Jun. 22, 1987 [IL] Israel ..... 82951
May 27, 1988 [IL] Israel ..... 86526

[51] Int. Cl.[4] ..... E05D 15/16

[52] U.S. Cl. ..... 160/201; 160/33; 160/36; 160/193; 160/203; 160/208

[58] Field of Search ..... 160/32, 33, 34, 35, 160/36, 25, 172, 173, 201, 203, 208, 307, 133, 193

[56] References Cited

U.S. PATENT DOCUMENTS

| | | | |
|---|---|---|---|
| 1,373,584 | 4/1921 | Armstrong | 160/201 |
| 2,874,771 | 2/1959 | Muhr | 160/33 |
| 3,304,994 | 2/1967 | Kozak | 160/193 |
| 3,788,678 | 1/1974 | Switzgable | 160/201 X |
| 4,350,199 | 9/1982 | Pino | 160/203 X |
| 4,378,043 | 3/1983 | Sorenson | 160/201 X |
| 4,444,241 | 4/1984 | Amsler et al. | 160/172 |
| 4,537,237 | 8/1985 | Sepulveda et al. | 160/201 |
| 4,662,420 | 5/1987 | Hirao | 160/32 |

FOREIGN PATENT DOCUMENTS

| | | | |
|---|---|---|---|
| 638446 | 4/1962 | Italy | 160/193 |

*Primary Examiner*—Ramon S. Britts
*Assistant Examiner*—David G. Kolman
*Attorney, Agent, or Firm*—Benjamin J. Barish

[57] ABSTRACT

A shutter for application over a window comprises a plurality of horizontal slats mounted in vertically-spaced relation, a tilting device for simultaneously tilting all the slats about their horizontal axes from horizontal positions to vertical positions, and a raising device for raising the slats from lowered positions to raised positions with respect to the window. The plurality of slats are mounted on shafts received within channels located at opposite sides of the window and guiding the movement of the shafts of the slats when the slats are tilted, raised and lowered.

12 Claims, 6 Drawing Sheets

WINDOW SHUTTER

BACKGROUND OF THE INVENTION

The present invention relates to window coverings, and particularly to a novel window shutter for controlling the amount of light and air permitted to pass through the window.

A large number of different types of window coverings or shutters are known. One type includes a frame having a plurality of slats tiltable to either an open or closed position, with the frame being slidably or hingedly mounted with respect to the window in order to completely open the window. Such shutters, however, require wall space on the sides of the window to accommodate the shutter when in its window-open position; moreover, such shutters require sliding or hinging structures which are costly to produce, install, maintain and repair.

Another type of shutter, called a "roll-up" shutter, includes a plurality of slats rolled around a shaft mounted horizontally at the top of the window. Such a shutter, however, requires a separate box or casing at the upper end of the window for accommodating the shaft and slats when in their wound condition on the shaft. In addition to the space requirements for the shutter housing at the top of the window, this type of shutter is also costly in construction, installation, maintainance and repair.

A still further type of window covering, called Venetian Blinds, includes a plurality of horizontally-extending slats pivotably mounted to a plurality of vertically-extending tapes such that the slats may be simultaneously tilted by a tilt cord, or lifted by a lift cord. A disadvantage of Venetian Blinds, however, is that they do not completely close the window opening against the entry of light or rain when this may be desired.

An object of the present invention is to provide a new type of window covering or shutter having advantages in the above respects.

BRIEF SUMMARY OF THE INVENTION

According to the present invention, there is provided a shutter for application to a window, comprising: a plurality of horizontal slats mounted in vertically-spaced relation and movable either to a lowered operative position with respect to the window, or to a raised position overlying the window, tilting means for simultaneously tilting all the slats about their horizontal axes from horizontal positions to vertical positions when the slats are in their lowered operative positions with respect to the window, and raising means for raising the slats from their lowered operative positions to raised horizontal positions with respect to the window. The plurality of slats are mounted on shafts received within channels located at opposite sides of the window and guiding the movement of the shafts of the slats when the slats are tilted, raised and lowered. The tilting means comprises a U-shaped profile member extending vertically within at least one of the channels and coupled to the ends of the slats, which profile member is supported by a parallel-link mechanism such that movement of the U-shaped profile member horizontally in one direction pivots the slats to their horizontal positions, and movement of the U-shaped profile member horizontally in the opposite direction pivots the slats to their vertical positions.

It will be seen that a shutter constructed in accordance with the foregoing features most closely resembles the known Venetian Blinds, except that in the shutter of the present invention the slats are mounted at their ends within channel members at the opposite sides of the window, which channel members guide the movements of the slats when tilted, raised and lowered. Such a construction better closes the window opening against the entry of light or rain.

Further features and advantages of the invention will be apparent from the description below.

BRIEF DESCRIPTION OF THE DRAWINGS

The invention is herein described, by way of example only, with reference to the accompanying drawings, wherein:

FIG. 11 illustrates another form of improved shutter constructed in accordance with the present invention, FIGS. 11*a*, 11*b* and 11*d* being sectional views along lines a—a, b—b and d—d of FIG. 11, while

DESCRIPTION OF PREFERRED EMBODIMENTS

Figure 4:
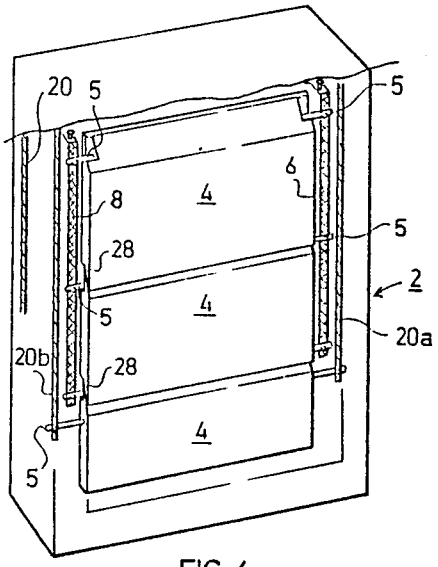
FIG. 4 illustrates the shutter with all the slats in their closed positions.
Figure 5:
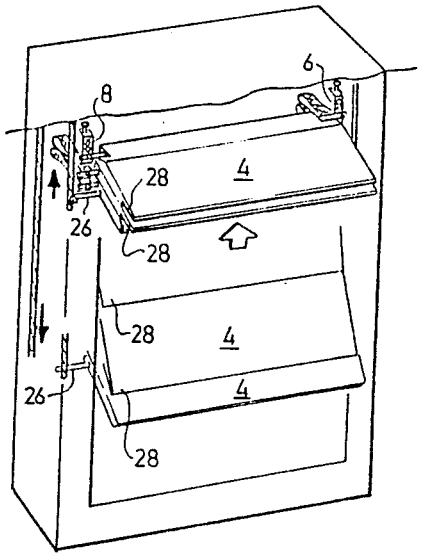
FIG. 5 illustrates the shutter showing how the slats are raised to their open positions.

The window shutter illustrated in FIGS. 1–5 of the drawings is adapted to be applied over a window for controlling the passage of light and air through the window. The shutter comprises a frame, generally designated 2, adapted to be mounted in the window opening, which frame includes a plurality of horizontal slats 4 mounted, via their end-projecting shafts 5, in vertically-space relationship to and between a pair of flexible elongated mounting members 6, 8 (FIGS. 4, 5). The slats may be moved from a normal, closed position illustrated in FIGS. 1 and 4, to an open raised position as illustrated in FIG. 5, by rotating a handle 10; they may also be simultaneously tilted about their horizontal axis from a vertical, closed position, to a horizontal, open position, by rotating a second handle 12 coaxial with respect to handle 10.

The flexible, elongated mounting members 6, 8, between which the slats 4 are pivotably mounted, are flexible strips or belts disposed within a pair of channel members 14, 16 fixed to the opposite sides of the shutter frame 2. The two channel members 14, 16 thus serve as guides or rails for positively guiding the movement of the shafts 5 of the slats 4 when the slats are moved either to their lower, closed positions or to their upper, open positions, as well as to any tilted position.

FIGS. 2–5 best illustrate the arrangement for raising and lowering the slats by rotating handle 10. Thus, handle 10 drives a drum 18 to which is secured the opposite ends of a cord 20 for raising and lowering the slats 4. One end of cord 20 is secured to drum 18, and the opposite end is wound around five direction-changing rollers 21, 22, 23, 24 and 25, before returning back and secured to drum 18. This arrangement provides two vertical stretches 20*a*, 20*b* which are moved together upwardly when drum 18 is rotated in one direction, and downwardly when the drum is rotated in the opposite direction.

Shaft 5 of the lowermost slat 4 is connected to stretches 20*a*, 20*b* of cord 20, rather than to the flexible belts 6, 8, to which the shafts 5 of the other slats are connected. Each slat 4, except the lowermost slat, is formed with an extension 28 depending from its lower edge for cooperation with the upper edge of the underlying slat. The cooperating faces in the extensions 28, and/or in the upper edge of the underlying slat 4, are preferably slanted.

The arrangement is such that when handle 10 is rotated to raise stretches 20*a*, 20*b* of cord 20, this raises the lowermost slat 4; and as its upper edge engages extension 28 of the next overlying slat, that slat is pivoted towards the horizontal position. Thus, continued rotation of handle 10 causes each slat 4 to be pivoted horizontally and then raised, until all the slats have been raised to their open positions, whereupon the slats assume a stacked horizontal position above the window opening.

Rotation of the second handle 12 effects the simultaneous tilting of all the slats about their horizontal shafts 5. Handle 12 may be locked against rotation so as to lock the slats 4 in any desired tilted position.

For this purpose, handle 12 is formed with a shank 30 (FIG. 3) passing through drum 18 and movable with respect to both in the rotary and axial directions. The opposite end of shank 30 is formed with an in-turned extension 30*a* passing through a roller 32 on which is wound another cord 34 used for tilting the slats 4. The frame 2 carries a stop member 36 formed with a plurality of recesses or openings 38 around its periphery in alignment with extension 30*a* of the handle shank 30 according to the rotary position of the handle. Extension 30*a* of the handle shank 30 is urged into one of the recesses 38 of stop member 36 by a spring 40 in order to lock handle 12 in position against rotation, but the handle may be manually released for rotation by merely pushing handle 12 inwardly against spring 40 to unseat its extension 30*a* from the recesses 38 of stop member 36.

Figure 6:
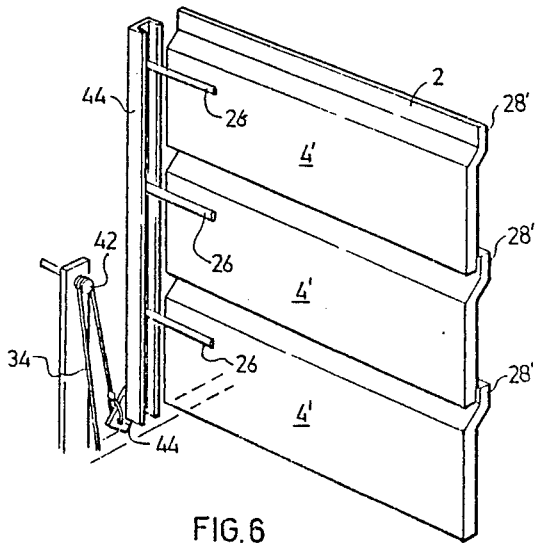
FIGS. 6, 7 and 8 illustrate a variation in the construction of the shutters and also the operation of the tilting means.
Figure 7:
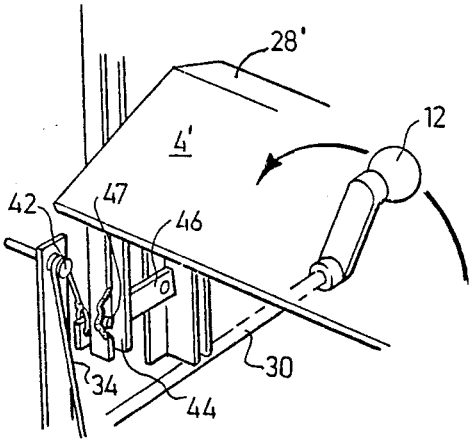
Figure 8:
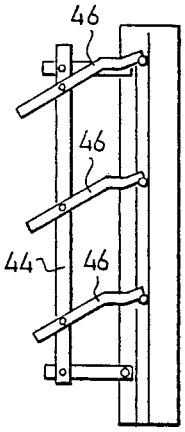

As shown in FIGS. 6 and 7, cord 34 is wound over a pin 42 and moves a tilt bar 44 coupled to the slats 4′ by means of an extension 46 pivotal to the frame and to the tilt bar. Thus, when handle 12 is rotated in one direction to lift tilt bar 44, all the slats are tilted towards their horizontal, open positions; and when the handle is rotated in the opposite direction to lower the tilt bar 44, all the slats are pivoted towards their vertical, closed positions. The slats are automatically locked in any tilted position by merely releasing handle 12, whereupon spring 40 moves extension 30*a* of the handle shank 30 into one of the recesses 38 of the stop member 36.

FIGS. 6 and 7 illustrate a slight variation in the construction of each slat, therein designated 4′, in that the extension 28′ is at the upper part of each slat and cooperates with the lower edge of the overlying slat, rather than being at the lower part of the slat and cooperating with the upper edge of the underlying slat as in FIGS. 1–5.

Figure 1:
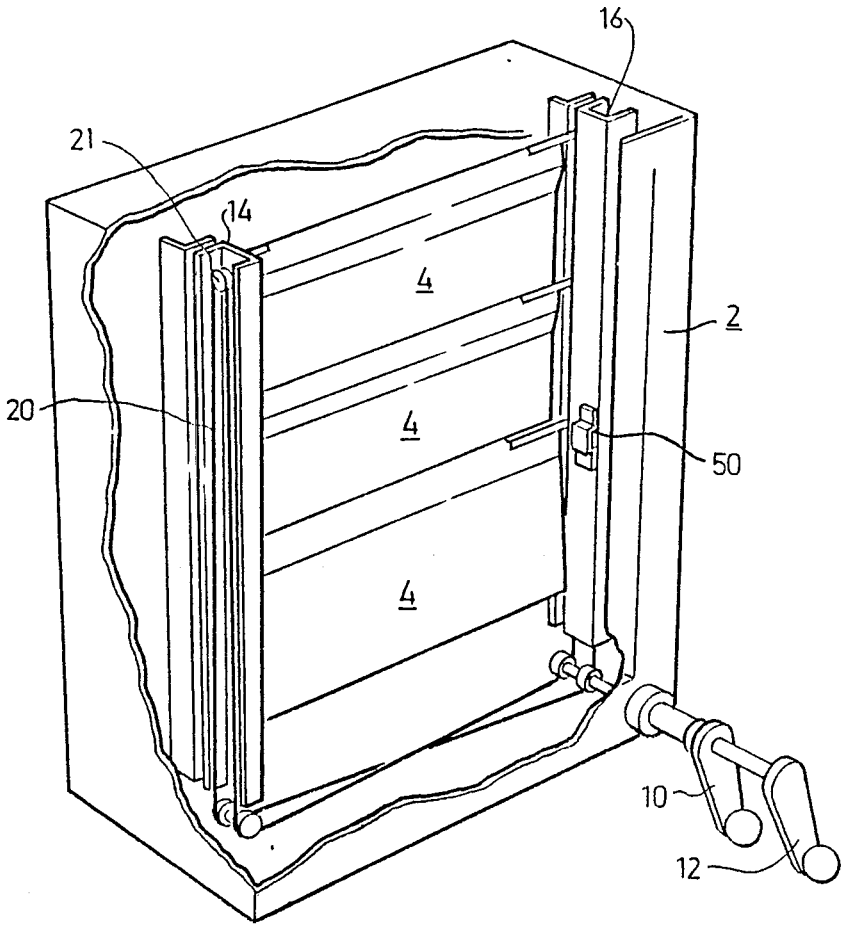
FIG. 1 is a three-dimensional view, with parts broken away to show internal structure, of one form of window shutter constructed in accordance with the present invention, the view being taken from the inside of the building structure.
Figure 2:
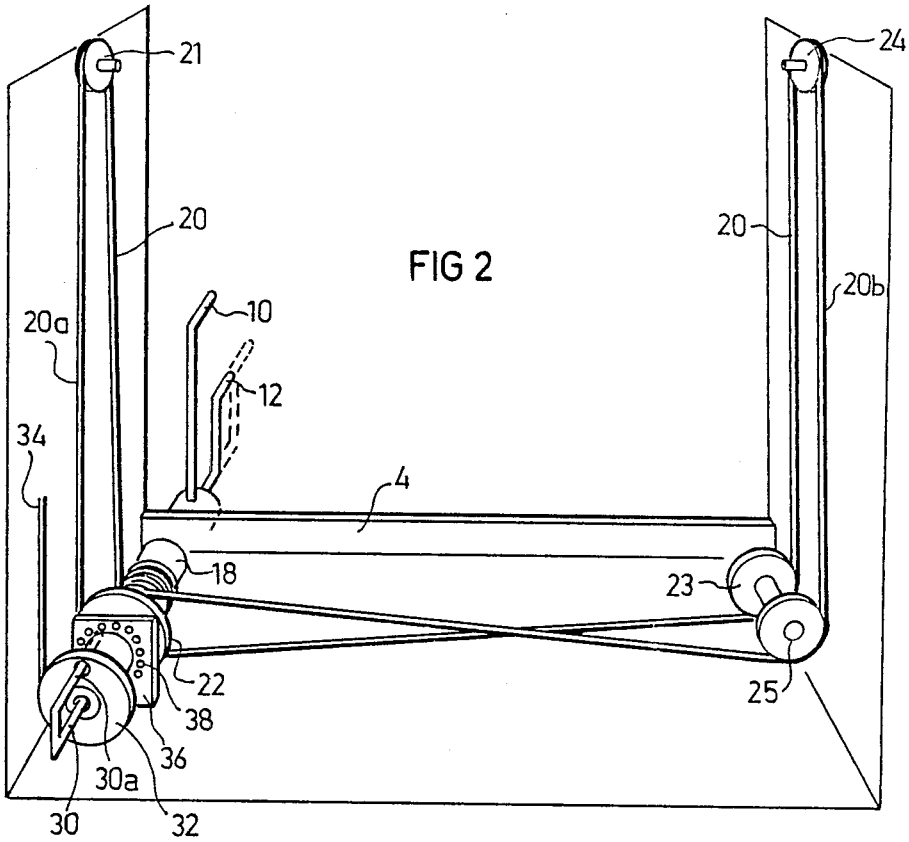
FIG. 2 is a three-dimensional view of certain operating parts of the shutter of FIG. 1 taken from outside the building structure.
Figure 3:
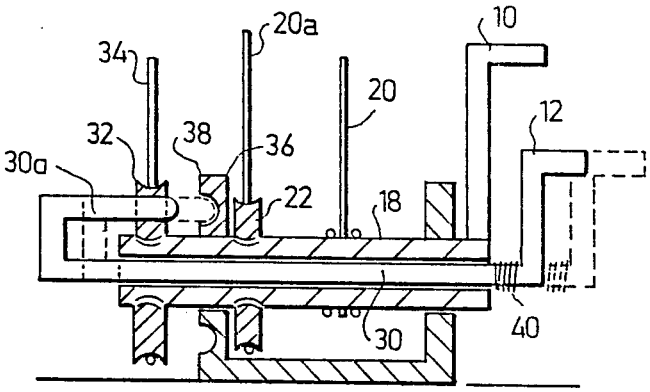
FIG. 3 is a side-elevational view illustrating the manual drives for raising and tilting the slats.
Figure 9:
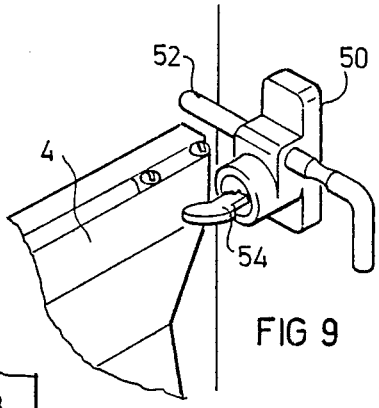
FIG. 9 is a three-dimensional view illustrating a key-operated lock that may be used for locking the shutters against forceful opening.

FIGS. 1 and 9 illustrate the inclusion of a key-operated lock, generally designated 50, which may be provided in order to lock the slats against forceful upward movement, e.g., by an attempted intruder. Lock 50 is secured to one of the channel members, e.g., channel member 16 of frame 2, just above the lowermost slat 4 when in its lowered position, and includes a bolt 52 which is projected to overlie the upper edge of the slat when the lock is operated by a key 54. Thus, when bolt 52 is in its projected position as illustrated in FIG. 9, it prevents the lowermost slat 4 from being forcefully raised, and thereby prevents an intruder from forcing the slats to their upper open positions.

The operation of the shutter illustrated in FIGS. 1–9 of the drawings will be apparent from the above description.

Thus, if the slats 4 are in their closed positions as illustrated in FIGS. 1 and 4, the slats may be raised to their open positions by rotating handle 10 which, via cord 20 wound on drum 18, raises the two vertical cord stretches 20*a*, 20*b* to which the shaft 5 (FIG. 4) of the lowermost slat 4 is secured, thereby raising the lowermost slat. As that slat is raised, the extension 28 depending from the next overlying slat 4 engages the upper edge of the lowermost slat, causing the next overlying slat 4 to pivot horizontally, and then also to be raised by the continued rotation of handle 10, until all the slats have been raised to their upper positions.

The slats may be simultaneously tilted to any desired position by first pushing handle 12 inwardly, against spring 40 (FIG. 3) in order to unseat handle extension 30*a* from the recesses 38 in the stop member 36, and then rotating the handle to the desired position. This rotation of the handle causes cord 34 to move tilt bar 44 either to its lowermost position (FIG. 6) pivoting the slats 4 to their vertical positions, or to its raised position pivoting the slats towards their horizontal positions. When handle 12 is released, spring 40 moves the handle shank 30 axially to bring its extension 30*a* into one of the recesses 38 of stop plate 36, to thereby lock the handle and the slats in their tilted positions.

The slats may be locked in their vertical lowered positions closing the window against forceful opening from the outside, by turning key 54 in lock 50 in order to project locking bar 52 over the lowermost slat 4.

Figure 10A:
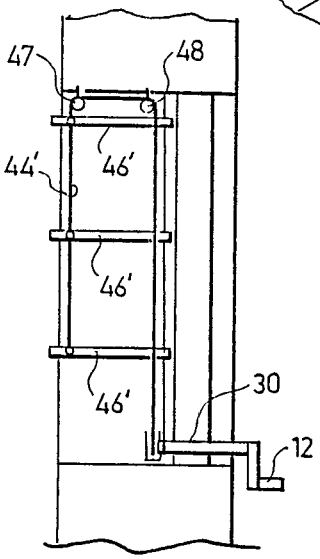
FIGS. 10*a* and 10*b* illustrate the operation of an alternative tilting means using a cord.
Figure 10B:
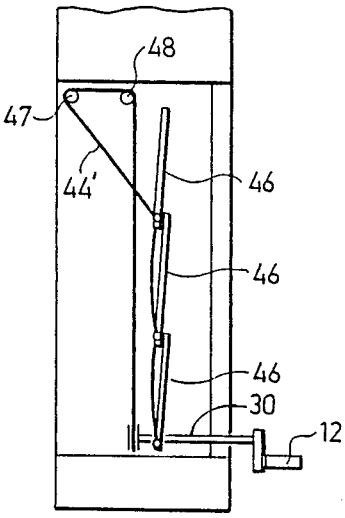

FIGS. 10*a* and 10*b* illustrate an alternative arrangement whereby a cord 44′ can either replace bar 4 (shown in FIGS. 6, 7, and 8), or be included in addition to bar 44. One end of the cord 44′ is attached to each of the slat extensions 46. Its opposite end is wound around two overhead pulleys 47,48 and is directly attached to shank 30 of handle 12. FIG. 10*a* illustrates the open positions of the slats, and FIG. 10*b* illustrates their closed positions.

Figure 13:
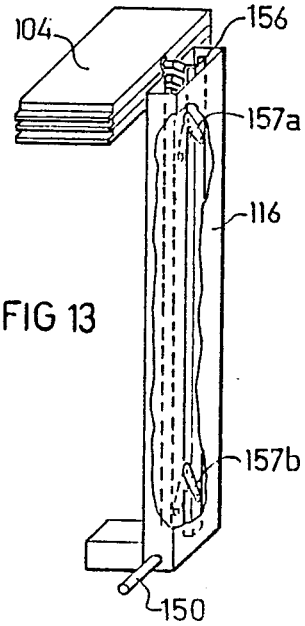
Figure 14:
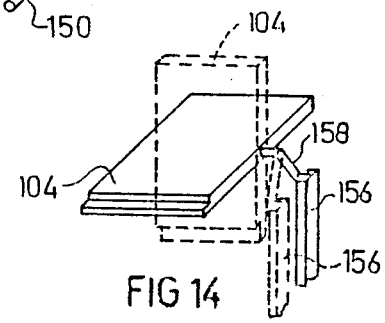

The window shutter illustrated in FIGS. 11–15 is adapted to be mounted in the window opening of a building 102 and includes a plurality of horizontal slats 104 mounted to and between a pair of flexible elongated mounting members 106, 108. The slats may be moved from a normal, closed position illustrated in FIG. 11 to an open, raised position as illustrated in FIG. 13 by means of a manually-rotatable member or handle 110; they also may be simultaneously tilted about their horizontal axes from a vertical, closed position to a horizontal, open position by rotating a second manually-rotatable member or knob 112.

The flexible, elongated mounting members 106, 108 between which the slats 104 are pivotally mounted, are in the form of flexible strips or belts disposed within a pair of channel members 114, 116 fixed to the opposite sides of the shutter. The two channel members 114, 116 thus serve as guides for positively guiding the movement of the ends of the slats 4 when they are moved either to their lower, closed positions or to their upper, open positions.

Figure 11:
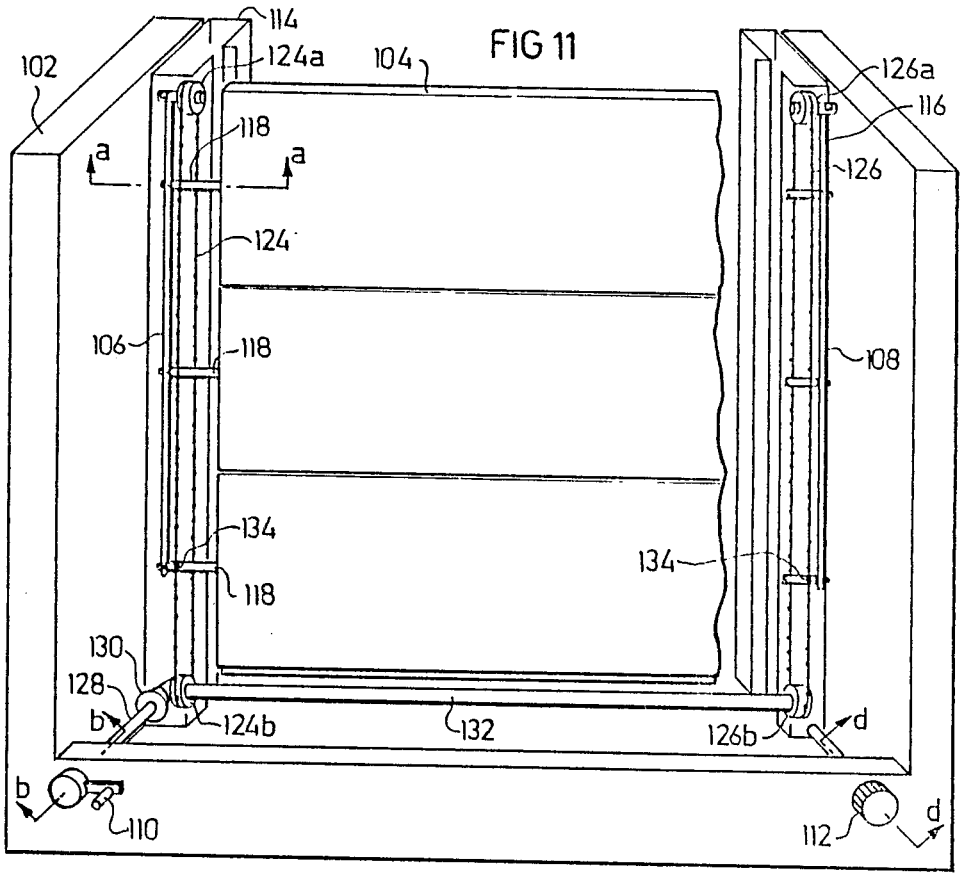
Figure 11A:
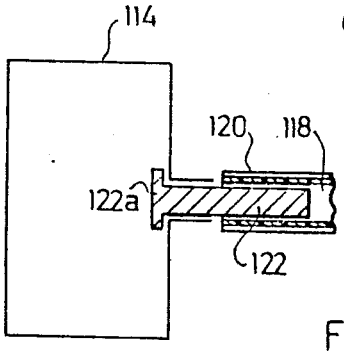

As shown in FIG. 11*a*, each of the slats 104 is pivotally mounted by means of a shaft 118 extending transversely through the respective slat and enclosed by a metal protective sleeve 120 preventing cutting-through the shaft. The slats and sleeves are open at their opposite ends, and each receives a pin 122 formed with an enlarged head 122*a* receivable within the respective channel member 114 (or 116). The shaft 118, sleeve 120 and pin 122 are all of square cross-section, and are received in a square cross-section opening extending through the length of the slat.

The slats 104 are raised and lowered, upon rotation of handle 110, by means of a pair of closed-loop belts 124, 126 supported between a pair of wheels 124*a*, 124*b* and 126*a*, 126*b* and extending vertically within channel member 114, 116 on opposite sides of the slats. Handle 110 is coupled by a shaft 128 and bevel gearing 130 to directly drive wheel 124*b* of the closed-loop belt 124; and wheel 124*b* is coupled by a coupling rod 132 to wheel 126*b* for driving the closed-loop belt 126. Shaft 118 of the lowermost slat 104 is fixed at its opposite ends to one side of each of the two closed-loop belts 124, 126, as shown at 134, such that rotating handle 110 in one direction raises the lowermost slat 104, and rotating the handle in the opposite direction lowers the lowermost slat. When the lowermost slat 104 is raised, it picks up the overlying slats and thereby also raises them; and when the lowermost slat is lowered, it permits the overlying slats to also be lowered to their respective vertically-spaced positions between the flexible, elongated, mounting members 106, 108.

In order to raise the slats 104 by rotating handle 110, it is necessary first to tilt them to their horizontal positions by rotating knob 112. The manner in which this is done is described more particularly below.

Figure 11B:
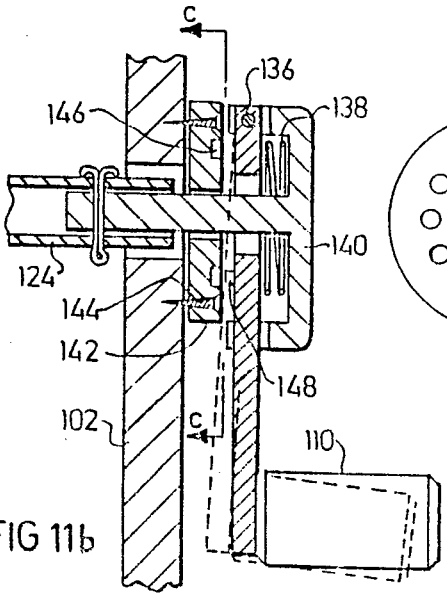
Figure 11C:
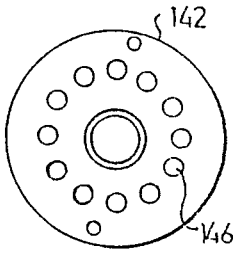
FIG. 11*c* is a sectional view along line c—c of FIG. 11*b.

The slats 104 may thus be raised to any vertical position by rotating handle 110. FIGS. 11*b* and 11*c* illustrate locking mechanism for locking the handle 110 in any rotated position, and thereby locking the slats 104 in their respective raised positions.

Thus, handle 110 is pivotally mounted to housing 102 by a pin 136 (FIG. 11*b*), and is urged towards the housing 102 by spring 138 interposed between the handle 110 and a cap 140. A locking plate 142 is secured to the housing 102 at the inner side of handle 110 by means of a plurality of fasteners 144. Locking plate 142 is formed with a circular array of openings or recesses 146 (FIG. 11*c*) adapted to selectively receive a pin 148 projecting from the inner face of handle 110.

In the normal condition of handle 110, spring 138 urges pin 148 into one of the openings 146 of locking plate 142, to thereby lock the handle in any rotated position. Since handle 110 is directly coupled to the two closed-loop belts 124, 126, via gearing 130 and coupling rod 132, this locks the belt and thereby the slats 104 in position. Whenever it is desired to raise or lower the slats, the operator pulls handle 110 outwardly, against the force of spring 138, to unseat pin 148 from opening 146, thereby freeing handle 110 for manual rotation in one or the other direction in order to raise or lower the slats.

As indicated earlier, before raising the slats, it is necessary to tilt them to their horizontal positions. This is accomplished by rotating knob 112.

Figure 11D:
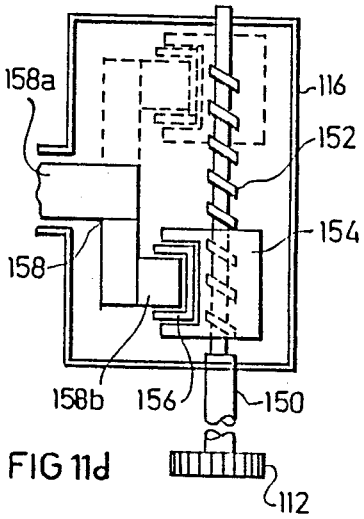
Figure 12:
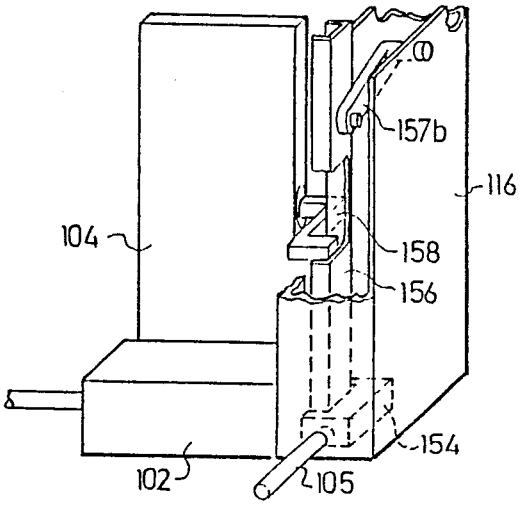
* and FIGS. 12–15 are fragmentary views illustrating constructional details of the shutter of FIG. 11.

As shown in FIG. 11*d*, knob 112 is secured to a shank 150 passing through an opening in channel member 116. The portion of shank 150 within channel member 116 is formed with threads 152 cooperable with a nut 154. Nut 154 carries a U-shaped profile member 156 which extends vertically for the complete height of channel member 116. The upper and lower ends of profile member 156 are pivotally coupled to a pair of parallel-links 157*a*, 157*b*, permitting the U-shaped profile member 156 to move parallel to shank 150 of knob 112.

The respective ends of the slats 104 (i.e., their right ends as illustrated in FIG. 11) are coupled to profile member 156 by crank levers 158. Thus, each crank lever 158 includes an arm 158*a* received within the opening through its respective slat 104 and thereby serves as the pivot shaft therefor, and another arm 158*b* received within the vertically-extending U-shaped profile member 156.

It will thus be seen that when knob 112 is rotated in one direction, this also moves nut 154 to shift the U-shaped profile member 156, carried by nut 154, towards or away from knob 112. This shifting of profile members 156 pivots the slats 104 via the crank levers 158 coupling the shafts 118 of the slats to the profile member 156, such that rotating knob 112 will pivot the slats either to their vertical positions (illustrated in broken lines in FIG. 14) or to their horizontal positions (illustrated in full lines in FIG. 14), according to the direction of rotation of the knob.

Figure 15:
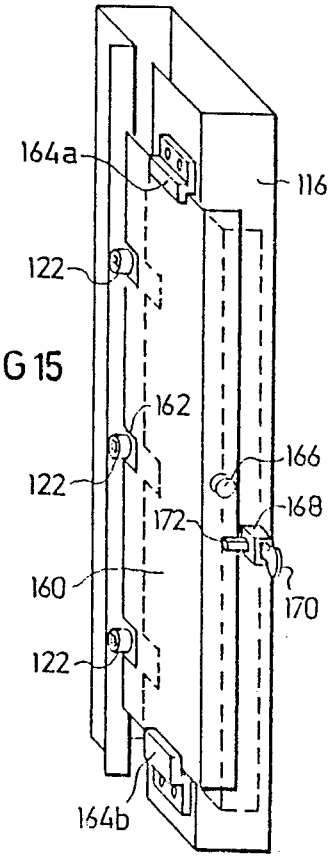

FIG. 15 illustrates a locking arrangement for securely locking the slats 104 in their lowered vertical positions to prevent an attempt of forceful entry through the slats. The locking device illustrated in FIG. 15 comprises a locking plate 160 slidably received within one (or both) of the channel members 116, 114. Locking plate 160 is formed with a plurality of notches 162 along one edge, which notches are aligned with the pins 122 of the slat shafts 118. Locking plate 160 is slidably supported between a pair of members 164*a*, 164*b* to either lock or release the shafts 118 with respect to notches 162, Thus, when plate 160 is moved to its full-line position illustrated in FIG. 15, it causes the pins 122 of shafts 118 to be seated within notches 162, thereby preventing these shafts, and their respective slats 104, from being raised either by handle 110, or forcefully by an intruder. In order to permit the slats to be raised by handle 110, locking plate 160 is slid to its broken-line position illustrated in FIG. 15, thereby moving the notches 162 clear of the pins 122 of shafts 118, permitting the shafts and their respective slats 104 to be raised.

Locking plate 160 is provided with a knob 166 facilitating the sliding of the plate. In addition, the channel member (e.g., 116) receiving the locking plate 160 may be provided with a lock 168 controlled by a key 170 and adapted to project a bolt 172 outwardly in order to engage the edge of locking plate 160, and thereby to prevent its movement to the slat-releasing position.

The manner of using the window shutter illustrated in the drawings will be apparent from the above description. Thus, whenever it is desired to tilt the slats about their horizontal axes, this may be done by rotating knob 112 which, by virtue of its coupling via nut 154, U-shaped profile member 156, and crank lever 158, to the shafts 118, rotates the shafts and thereby pivots their respective slats 104.

Whenever it is desired to raise the slats 104, the slats must first be pivoted to their horizontal positions by operating knob 112, and they may then be raised by rotating handle 110. Thus, rotation of handle 110 rotates the two closed-loop belts 124, 126 on opposite sides of the slats; the connection 134 of the lowermost slat 104 to the two belts causes the lowermost slat to rise and, during its rising movement, to pick-up the overlying slats 104.

Should it be desired to lock the slats in their lowered vertical positions, this may be done by sliding locking plate 160 (FIG. 15) to move its notches 162 into engagement with the pins 122 of shafts 118 of the slats 104, thereby locking the slats against any vertical movement.

While the invention has been described with respect to two preferred embodiments, it will be appreciated that many other variations, modifications and applications of the invention may be made.

What is claimed is:

1. A shutter for application to a window comprising a plurality of horizontal slats mounted in vertically-spaced relation and movable either to a lowered operative position with respect to the window, or to a raised position overlying the window, tilting means for simultaneously tilting all said slats about their horizontal axes from horizontal positions to vertical positions when the slats are in their lowered operative positions with respect to the window, and raising means for raising the slats from their lowered operative positions to raised horizontal positions with respect to the window; said plurality of slats being mounted on shafts received within channels located at opposite sides of the window and guiding the movement of the shafts of the slats when the slats are tilted, raised and lowered; and tilting means comprising a U-shaped profile member extending vertically within at least one of the channels and coupled to the ends of said slats, said U-shaped profile member being supported by a parallel-link mechanism such that movement of the U-shaped profile member horizontally in one direction pivots the slats to their horizontal positions, and pivoting the U-shaped profile member horizontally in the opposite direction pivots the slats to their vertical positions.

2. The shutter according to claim 1, further including locking means for locking said slats in their vertical, lowered positions closing the window.

3. The shutter according to claim 2, wherein each of said shafts is enclosed by a metal protective sleeve.

4. The shutter according to claim 2, wherein said locking means comprises a locking plate formed with notches along one edge and slidable to seat the ends of the shafts of the slats within the notches, when the slats are in their lowered, vertical positions, to thereby lock the slats in such positions.

5. The shutter according to claim 1, wherein said raising means comprises a pair of closed-loop belts each supported between a pair of wheels and extending vertically on each of the opposite sides of the slats, each of said closed-loop belts being disposed within one of said channel members and being fixed to the lowermost slat of the shutter.

6. The shutter according to claim 5, wherein said raising means further comprises a manually-rotatable member, gearing coupling said manually-rotatable member to a wheel of one closed-loop belt, and a coupling rod connecting said roller of said one closed-loop belt to a roller of the other closed-loop belt and extending transversely across the shutter.

7. The shutter according to claim 5, wherein said tilting means further comprises a locking disc formed with a circular array of locking openings, and said manually-rotatable member comprises a pin spring-urged into one of said locking openings when said manually-rotatable member is released for locking the slats in any tilted position.

8. The shutter according to claim 1, wherein said tilting means further comprises a manually-rotatable member formed with a threaded shank, and a nut movable along said threaded shank and coupled to said U-shaped profile member to tilt said slats upon movement of said nut by the rotation of said manually-rotatable member.

9. The shutter according to claim 8, wherein said vertically-extending U-shaped profile member is coupled to said slats by a plurality of crank levers having one end coupled to said U-shaped profile member, and the opposite end coupled to its respective slat.

10. The shutter according to claim 1, wherein said tilting means comprises a first rotary handle and a tilting mechanism driven thereby, and said raising means comprises a second rotary handle coaxial with said first rotary handle and coupled to a raising mechanism driven thereby.

11. A shutter for application over a window comprising:

a plurality of horizontal slats mounted in vertically-spaced relation;

tilting means including a first handle for simultaneously tilting all said slats about their horizontal axes from horizontal positions to vertical positions;

raising means including a second handle coaxial with said first handle for raising the slats from lowered positions to raised positions with respect to the window;

said plurality of slats being mounted on shafts received within channels located at opposite sides of the window and guiding the movement of the shafts of the slats when the slats are tilted, raised and lowered; and locking means for locking said slats in their vertical, lowered positions closing the window.

12. The shutter according to claim 11, wherein said tilting means further comprises a locking disc formed with a circular array of locking openings, and said first handle is coupled to a pin spring-urged into one of said locking openings when said first handle is released for locking the slats in any tilted position.

* * * * *